US006532703B1

(12) United States Patent
Barrens

(10) Patent No.: US 6,532,703 B1
(45) Date of Patent: Mar. 18, 2003

(54) PORTABLE SCREEN DOOR

(76) Inventor: Alan K. Barrens, 2104 Parkhaven Dr., Plano, TX (US) 75075

( * ) Notice: Subject to any disclaimer, the term of this patent is extended or adjusted under 35 U.S.C. 154(b) by 48 days.

(21) Appl. No.: 09/833,481

(22) Filed: Apr. 12, 2001

(51) Int. Cl.[7] ..... E06B 3/26; E06B 1/04; E06B 9/00; E04G 1/22; A47G 5/00

(52) U.S. Cl. ..... 52/202; 52/204.1; 52/656.7; 52/126.1; 52/126.4; 160/371; 160/377; 160/351; 160/215

(58) Field of Search ..... 52/202, 204.1, 52/656.7, 656.2, 222, 71, 69, 126.1, 126.4, 243.1; 160/371, 377, 351, 215; 49/463

(56) References Cited

U.S. PATENT DOCUMENTS

| | | | | | |
|---|---|---|---|---|---|
| 704,541 | A | * | 7/1902 | Holy | |
| 1,770,612 | A | * | 7/1930 | Gullicksen | |
| 1,985,270 | A | * | 12/1934 | Zeller | |
| 3,762,116 | A | * | 10/1973 | Anderson | 52/239 |
| 3,997,144 | A | * | 12/1976 | Parisien | 256/32 |
| 4,874,028 | A | | 10/1989 | Lynch et al. | |
| 4,909,004 | A | | 3/1990 | Panttila | |
| 4,947,594 | A | * | 8/1990 | Theobald | 52/126.4 |
| 4,972,634 | A | * | 11/1990 | Dresden | 52/69 |
| 5,048,587 | A | | 9/1991 | York | |
| 5,231,809 | A | | 8/1993 | Benjamino et al. | |
| D361,629 | S | | 8/1995 | Tweedt | |
| 5,457,914 | A | * | 10/1995 | Johnson | 49/463 |
| 5,657,809 | A | * | 8/1997 | Longoria | 160/369 |
| 5,775,400 | A | | 7/1998 | Wilkinson | |
| 5,797,223 | A | * | 8/1998 | Shoup | 52/204.1 |
| 6,079,157 | A | * | 6/2000 | Hincher | 49/57 |
| 6,176,042 | B1 | * | 1/2001 | Rossman | 49/463 |
| 6,240,996 | B1 | * | 6/2001 | Runions | 160/105 |

* cited by examiner

*Primary Examiner*—Carl D. Friedman
*Assistant Examiner*—Kevul McDermott

(57) ABSTRACT

A portable screen door for positioning in an apartment doorway. The portable screen door includes a frame having a first side bar, a second side bar, a top bar and a bottom bar. A screen extends between and is attached to the first side bar, the second side bar, the top bar and the bottom bar. The screen extends along each of the bars. A first support holds the frame in a doorframe. The support is elongated and has a first end and a second end. The first side bar of the frame is hingedly coupled to the support. At least one biasing member removably biases the support against the doorframe. The biasing member is removably extendable from one of the ends of the support.

9 Claims, 4 Drawing Sheets

PORTABLE SCREEN DOOR

BACKGROUND OF THE INVENTION

1. Field of the Invention

The present invention relates to screen door devices and more particularly pertains to a new portable screen door for positioning in an apartment doorway.

2. Description of the Prior Art

The use of screen door devices is known in the prior art. More specifically, screen door devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,231,809; U.S. Pat. No. 5,048,587; U.S. Pat. No. 4,909,004; U.S. Des. Pat. No. 361,629; U.S. Pat. No. 4,874,028; and U.S. Pat. No. 5,775,400.

While these devices fulfill their respective, particular objectives and requirements, the aforementioned patents do not disclose a new portable screen door. The inventive device includes a frame having a first side bar, a second side bar, a top bar and a bottom bar. A screen extends between and is attached to the first side bar, the second side bar, the top bar and the bottom bar. The screen extends along each of the bars. A first support holds the frame in a doorframe. The support is elongated and has a first end and a second end. The first side bar of the frame is hingedly coupled to the support. At least one biasing member removably biases the support against the doorframe. The biasing member is removably extendable from one of the ends of the support.

In these respects, the portable screen door according to the present invention substantially departs from the conventional concepts and designs of the prior art, and in so doing provides an apparatus primarily developed for the purpose of positioning in an apartment doorway.

SUMMARY OF THE INVENTION

In view of the foregoing disadvantages inherent in the known types of screen door devices now present in the prior art, the present invention provides a new portable screen door construction wherein the same can be utilized for positioning in an apartment doorway.

The general purpose of the present invention, which will be described subsequently in greater detail, is to provide a new portable screen door apparatus and method which has many of the advantages of the screen door devices mentioned heretofore and many novel features that result in a new portable screen door which is not anticipated, rendered obvious, suggested, or even implied by any of the prior art screen door devices, either alone or in any combination thereof.

To attain this, the present invention generally comprises a frame having a first side bar, a second side bar, a top bar and a bottom bar. A screen extends between and is attached to the first side bar, the second side bar, the top bar and the bottom bar. The screen extends along each of the bars. A first support holds the frame in a doorframe. The support is elongated and has a first end and a second end. The first side bar of the frame is hingedly coupled to the support. At least one biasing member removably biases the support against the doorframe. The biasing member is removably extendable from one of the ends of the support.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable screen door apparatus and method which has many of the advantages of the screen door devices mentioned heretofore and many novel features that result in a new portable screen door which is not anticipated, rendered obvious, suggested, or even implied by any of the prior art screen door devices, either alone or in any combination thereof.

It is another object of the present invention to provide a new portable screen door which may be easily and efficiently manufactured and marketed.

It is a further object of the present invention to provide a new portable screen door which is of a durable and reliable construction.

An even further object of the present invention is to provide a new portable screen door which is susceptible of a low cost of manufacture with regard to both materials and labor, and which accordingly is then susceptible of low prices of sale to the consuming public, thereby making such portable screen door economically available to the buying public.

Still yet another object of the present invention is to provide a new portable screen door which provides in the apparatuses and methods of the prior art some of the advantages thereof, while simultaneously overcoming some of the disadvantages normally associated therewith.

Still another object of the present invention is to provide a new portable screen door for positioning in an apartment doorway.

Yet another object of the present invention is to provide a new portable screen door which includes a frame having a first side bar, a second side bar, a top bar and a bottom bar. A screen extends between and is attached to the first side bar, the second side bar, the top bar and the bottom bar. The screen extends along each of the bars. A first support holds the frame in a doorframe. The support is elongated and has a first end and a second end. The first side bar of the frame is hingedly coupled to the support. At least one biasing member removably biases the support against the doorframe. The biasing member is removably extendable from one of the ends of the support.

Still yet another object of the present invention is to provide a new portable screen door that allows a person in an apartment to keep their doorway open while positioning an air-permeable barrier in the doorway.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
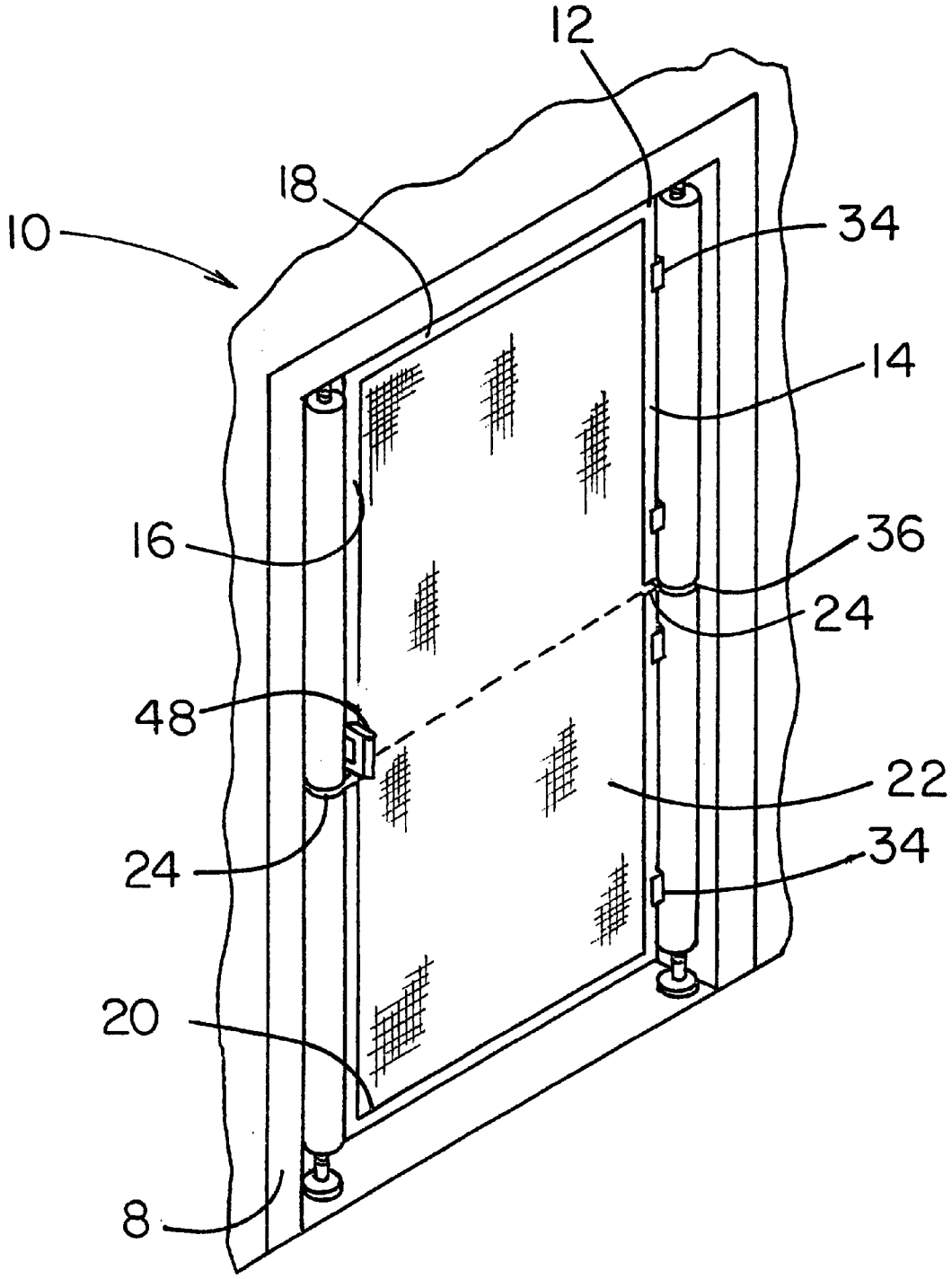
FIG. 1 is a schematic perspective view of a new portable screen door according to the present invention.
Figure 2:
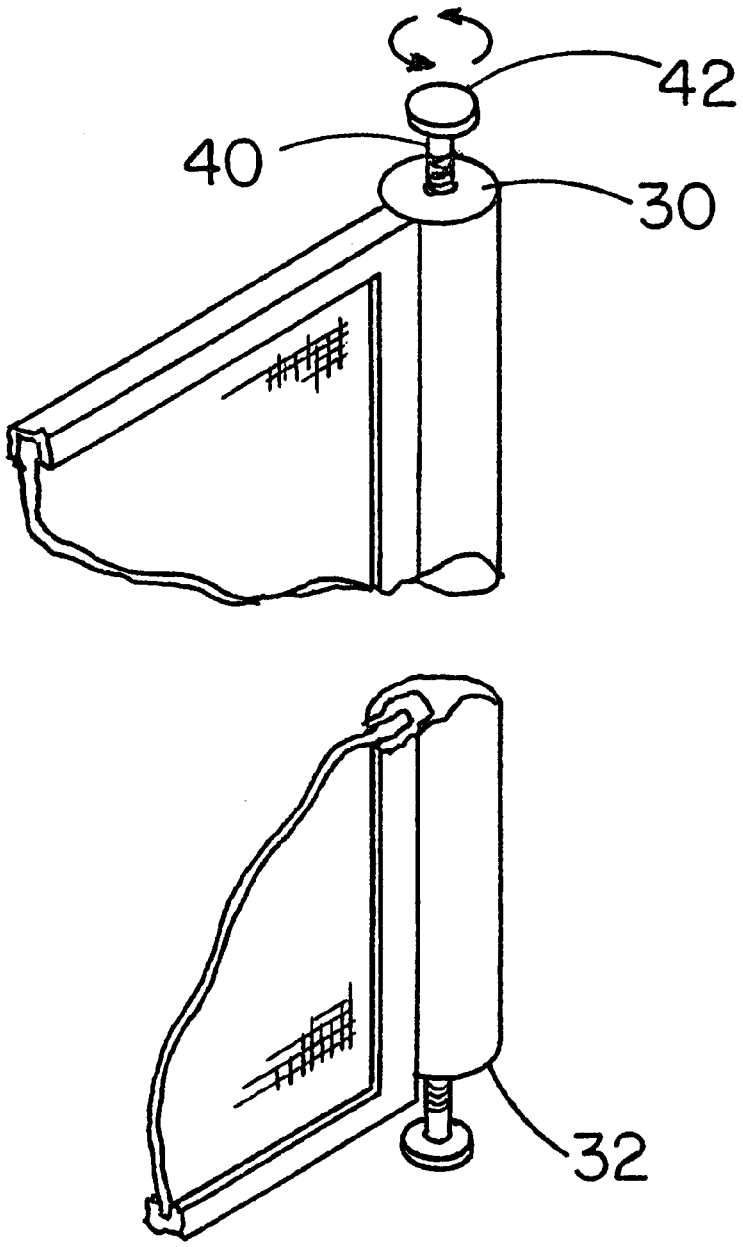
FIG. 2 is a schematic perspective view of the biasing members of the present invention.
Figure 3:
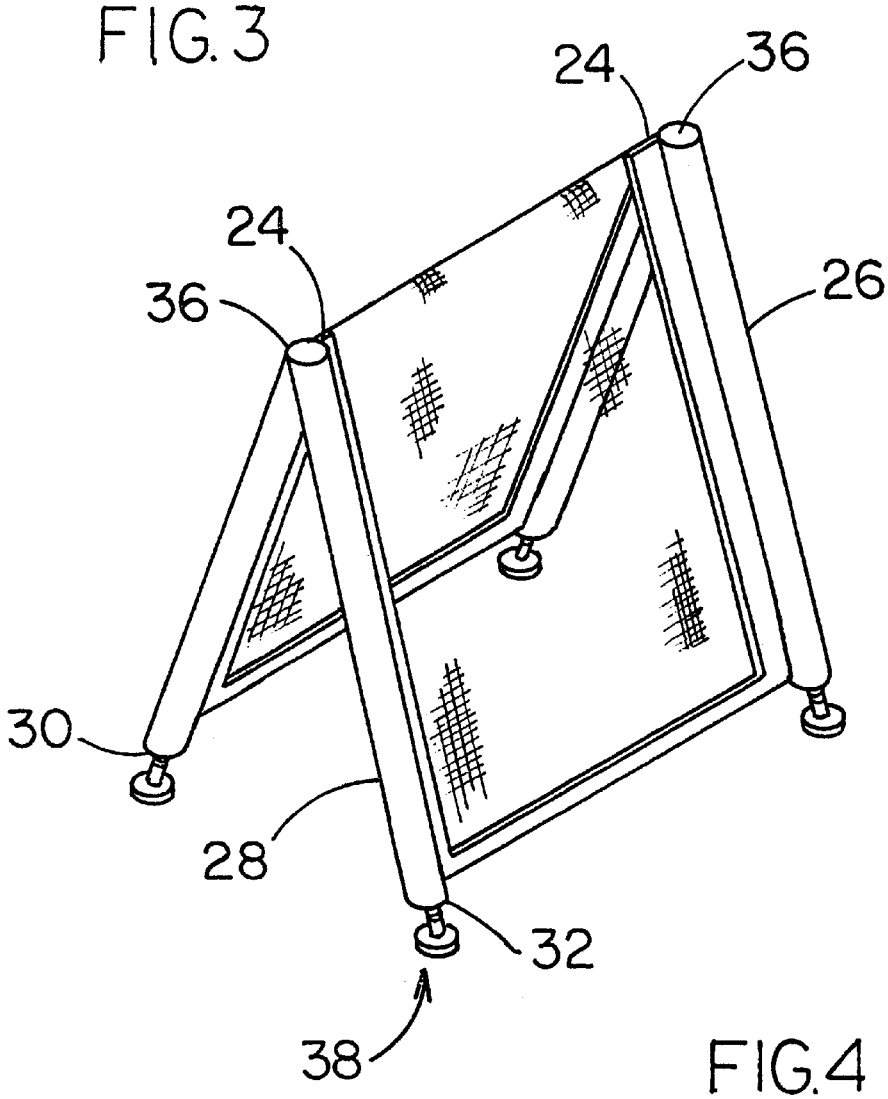
FIG. 3 is a schematic perspective view of the present invention.
Figure 4:
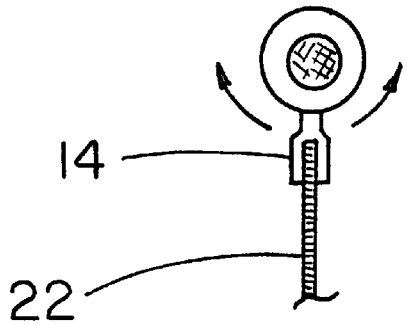
FIG. 4 is a schematic top view of the present invention.
Figure 5:
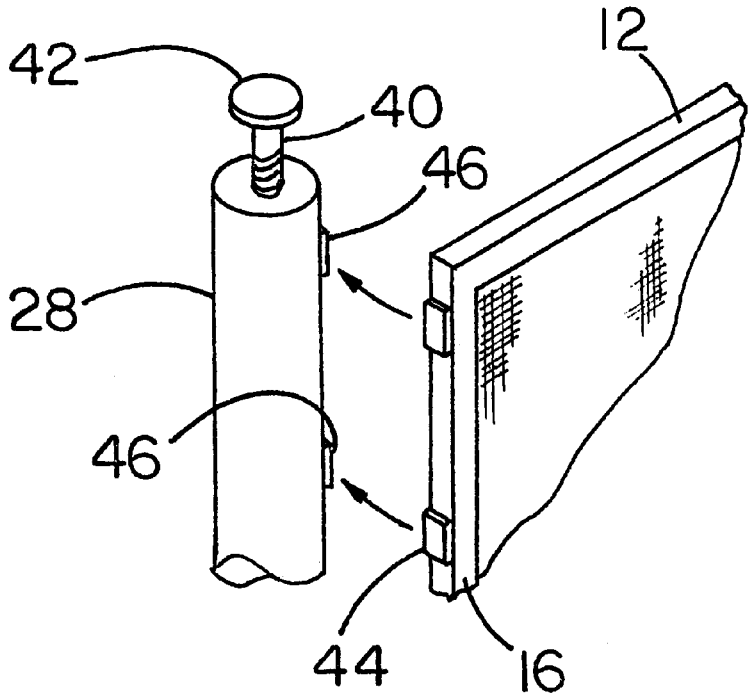
FIG. 5 is a schematic perspective view of the present invention.
Figure 6:
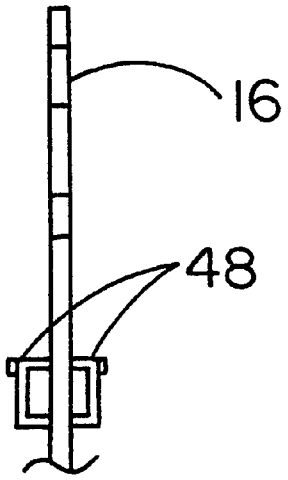
FIG. 6 is a schematic side view of the second side bar of the present invention.

With reference now to the drawings, and in particular to FIGS. 1 through 6 thereof, a new portable screen door embodying the principles and concepts of the present invention and generally designated by the reference numeral 10 will be described.

As best illustrated in FIGS. 1 through 6, the portable screen door 10 generally comprises a frame 12 having a first side bar 14, a second side bar 16, a top bar 18 and a bottom bar 20. A conventional screen 22 extends between and is attached to the first side bar 14, the second side bar 16, the top bar 18 and the bottom bar 20. The screen 22 extends along each of the bars. Each of the first 14 and second 16 side bars has a break 24 therein positioned between opposite ends of the side bars 14, 16.

A pair of supports 26, 28 holds the frame 12 in a doorframe 8. Each of the supports 26 is elongated and has a first end 30 and a second end 32. The first side bar 14 of the frame 12 is hingedly coupled to a first of the supports 26 by a plurality of hinges 34. Each of the supports 26, 28 has a length substantially equal to a length of the side bars 14, 16. The supports 26, 28 each have a break 36 therein positioned between and first 26 and second 28 ends of the supports.

A plurality of biasing members 38 removably biases the supports against the doorframe 8. Each of the biasing members 38 is removably extendable from one of the ends 30, 32 of the supports 26, 28. The biasing members 38 comprise a rod 40 extending into and threadably engaging one of the ends of the supports. Each of the rods 40 has an exposed end having a plate 42 thereon. The rods 40 are extended such that the plates 42 abut the doorframe 8.

A fastener removably fastens a second of the supports 28 to the second side bar 16. The fastener preferably comprises a plurality of metal panels 44 secured to an outer edge of the second bar 16 and plurality of magnets 46 secured to the second support 28. Each of the magnets 46 is positioned such that each is alignable with one of the metal panels 44 for magnetically coupling to the panels 44. Alternative fasteners such as catches and latches may be utilized.

Each of a pair of handles 48 is attached to the second side bar 16. Each of the handles 48 is positioned on opposite sides of the second side bar 16.

In use, the device 10 is used for positioning a screen-door type device within a doorway of an apartment. The supports 26, 28 are positioned in the doorway 8 and the biasing members 38 extended such that the supports are held in place. The supports and side bars have breaks 24, 36 therein for folding the device 10 during storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A removable screen door assembly for removably positioning in a doorframe, said assembly comprising:

a frame having a first side bar, a second side bar, a top bar and a bottom bar, a screen extending between and being attached to said first side bar, said second side bar, said top bar and said bottom bar, said screen extending along each of said bars;

a first support for holding said frame in the doorframe, said support being elongated and having a first end and a second end, said first side bar of said frame being hingedly coupled to said support;

at least one biasing member for removably biasing said support against said doorframe, said biasing member being removably extendable from one of said ends of said support; and each of said first and second side bars having a break therein positioned between opposite ends of said side bars, said first support having a length substantially equal to a length of said side bars, said first support having a break positioned between the first end and the second end of said first support.

2. The removable screen door assembly as in claim 1, further including:

a second support having a length and shape substantially identical to said first support for holding said frame in the doorframe, each of said supports being elongated and having a first end and a second end, said first side bar of said frame being hingedly coupled to said first support;

at least one biasing member for removably biasing said second support against said doorframe, said biasing member being removably extendable from one of said ends of said second support; and a fastener for removably fastening said second support to said second side bar.

3. The removable screen door assembly as in claim 2, wherein said fastener comprises a plurality of metal panels secured to an outer edge of said second bar and plurality of magnets secured to said second supports, each of said magnets being positioned such that each is alignable with one of said metal panels.

4. The removable screen door assembly as in claim 2, wherein each of said biasing members comprise a rod extending into and threadably engaging one of the ends of the supports, each of said rods having an exposed end having a plate thereon, wherein said rods are extended such that said plates abut said doorframe.

5. The removable screen door assembly as in claim 3, further including a pair of handles being attached to said second side bar, each of said handles being positioned on opposite sides of said second side bar.

6. A removable screen door assembly for removably positioning in a doorframe, said assembly comprising:

a frame having a first side bar, a second side bar, a top bar and a bottom bar, a screen extending between and being attached to said first side bar, said second side bar, said top bar and said bottom bar, said screen extending along each of said bars, each of said first and second side bars having a break therein positioned between opposite ends of said side bars;

a pair of supports for holding said frame in the doorframe, each of said supports being elongated and having a first end and a second end, said first side bar of said frame being hingedly coupled to a first of said supports, each of said supports having a lengths substantially equal to a length of said side bars, each of said supports having break therein positioned between said first and second ends of said supports;

a plurality of biasing members for removably biasing said supports against said doorframe, each of said biasing members being removably extendable from one of said ends of said supports, each of said biasing members comprising a rod extending into and threadably engaging one of the ends of the supports, each of said rods having an exposed end having a plate thereon, wherein said rods are extended such that said plates abut said doorframe;

a fastener for removably fastening a second of said supports to said second side bar, said fastener comprising a plurality of metal panels secured to an outer edge of said second bar and plurality of magnets secured to said second support, each of said magnets being positioned such that each is alignable with one of said metal panels; and a pair of handles being attached to said second side bar, each of said handles being positioned on opposite sides of said second side bar.

7. A removable screen door assembly for removably positioning in a doorframe, said assembly comprising:

a frame having a first side bar, a second side bar, a top bar and a bottom bar, a screen extending between and being attached to said first side bar, said second side bar, said top bar and said bottom bar, said screen extending along each of said bars;

a first support for holding said frame in the doorframe, said support being elongated and having a first end and a second end, said first side bar of said frame being hingedly coupled to said support;

at least one biasing member for removably biasing said support against said doorframe, said biasing member being removably extendable from one of said ends of said support;

a second support having a length and shape substantially identical to said first support for holding said frame in the doorframe, each of said supports being elongated and having a first end and a second end, said first side bar of said frame being hingedly coupled to said first support;

at least one biasing member for removably biasing said second support against said doorframe, said biasing member being removably extendable from one of said ends of said second support; and a fastener for removably fastening said second support to said second side bar; wherein said fastener comprises a plurality of metal panels secured to an outer edge of said second bar and a plurality of magnets secured to said second supports, each of said magnets being positioned such that each is alignable with one of said metal panels.

8. The removable screen door assembly as in claim 7, wherein each of said biasing members comprise a rod extending into and threadably engaging one of the ends of the supports, each of said rods having an exposed end having a plate thereon, wherein said rods are extended such that said plates abut said doorframe.

9. The removable screen door assembly as in claim 7, further including a pair of handles being attached to said second side bar, each of said handles being positioned on opposite sides of said second side bar.

* * * * *